United States Patent [19]

Hohlweg et al.

[11] Patent Number: 4,586,870

[45] Date of Patent: May 6, 1986

[54] METHOD AND APPARATUS FOR REGULATING POWER CONSUMPTION WHILE CONTROLLING SURGE IN A CENTRIFUGAL COMPRESSOR

[75] Inventors: William C. Hohlweg, Pittsburgh; Edward Condrac, North Huntingdon, both of Pa.

[73] Assignee: Elliott Turbomachinery Co., Inc., Jeannette, Pa.

[21] Appl. No.: 609,901

[22] Filed: May 11, 1984

[51] Int. Cl.[4] ..... F04D 27/02

[52] U.S. Cl. ..... 415/1; 415/27; 417/26; 417/53

[58] Field of Search ..... 415/1, 11, 26, 27, 28; 417/26, 44, 45, 53; 60/39.27, 39.29

[56] References Cited

U.S. PATENT DOCUMENTS

| | | | |
|---|---|---|---|
| 1,154,959 | 9/1915 | Banner | 415/27 |
| 2,490,188 | 12/1949 | Ziebolz | 415/27 |
| 3,411,702 | 11/1968 | Metot et al. | 415/27 |
| 3,630,496 | 12/1971 | Hurst et al. | 415/26 |
| 4,203,701 | 5/1980 | Abbey | 415/1 |
| 4,405,290 | 9/1983 | Rannenberg | 415/27 |
| 4,460,310 | 7/1984 | Plunkett | 415/27 |
| 4,464,720 | 8/1984 | Agarwal | 415/1 |

FOREIGN PATENT DOCUMENTS

| | | | |
|---|---|---|---|
| 2046629 | 1/1972 | Fed. Rep. of Germany | 415/27 |

*Primary Examiner*—Louis J. Casaregola

*Attorney, Agent, or Firm*—Robert P. Hayter

[57] ABSTRACT

A method and apparatus for regulating power consumption while controlling surge in a centrifugal compressor are disclosed. Various operating parameters of a centrifugal compressor are measured and based upon these parameters control of the power consumption of the compressor motor via inlet guide vanes and/or diffuser vanes is achieved. Additionally, the control senses and regulates power consumption and vane positioning to control operation under surge conditions and will, if necessary, energize a blow-off valve to prevent operation under surge conditions. The control is designed to integrate compressor and motive source operation to effectively minimize power consumption while avoiding operation in the surge range.

11 Claims, 2 Drawing Figures

MOTOR
30
CONTROL
20
PT
TT
hT
JT
ΔPT
BV
PMEAS
JMEAS
IGV
DV
$h_D$
$T_D$
$P_D$
ΔPMEAS
$T_{IN}$
10
12
14
16
18
22
24
26
40
42
44
46
48
50
52

METHOD AND APPARATUS FOR REGULATING POWER CONSUMPTION WHILE CONTROLLING SURGE IN A CENTRIFUGAL COMPRESSOR

BACKGROUND OF THE INVENTION

This invention relates to a method and to apparatus for controlling a centrifugal compressor. More particularly the herein invention concerns measuring various operating parameters and controlling inlet guide vanes and/or diffuser vanes to effectively regulate power consumption while preventing operation under surge conditions.

Centrifugal compressors are used in many process applications and can be used in any application where it is desirable to increase the pressure of large volumes of gaseous material. Centrifugal compressors are typically powered by an electric motor at a preselected operating speed. The electrical energy consumed by the motor to drive the compressor varies with the work done by the compressor which is a function of the volume flow of gas therethrough. The volume flow rate of gas entering the compressor is controlled by inlet guide vanes which are positioned to regulate the flow of gas into compressor inlet.

In order to efficiently operate a compressor it is important to control the inlet guide vanes in response to a system parameter such that the energy consumption of the motor driving the compressor may be minimized. The parameter to which the inlet guide vanes can be controlled may include pressure or the volume of the discharge from the compressor. By effectively matching the volume flow through the compressor to the load on the system the power consumed by the motor may be minimized.

A centrifugal compressor under certain operating conditions will enter surge. Surge may occur in the portion of the operating range of the compressor where the volume flow and pressure are such that the flow through the compressor diffuser is aerodynamically unstable and may actually flow backwards. Operating a compressor under these conditions creates severe noise, high mechanical stresses and may result in immediate failure of the compressor. It is desirable to avoid operating under these conditions hence minimum pressure differentials occasioned by minimum flow requirements and the necessary power consumption to the motor to achieve these minimum power requirements are necessary to avoid operating in surge.

A centrifugal compressor operates by receiving gas and accelerating that gas outwardly along an impeller. The gas is then discharged into the diffuser which extends radially outward from the impeller. Within the diffuser velocity pressure generated by the impeller is converted to static pressure to achieve the pressure gain across the compressor. Under full load operating conditions the gas being discharged from the impeller has both a tangential vector perpendicular to the impeller blade and a radially outward vector caused by the flow of additional gas into the impeller. A combination of these vectors acts to force the gas spirally outwardly through the diffuser having a flow path of a known length. The diffuser is designed to achieve the desired static pressure gain over this length flow path to have the compressor operate under designed conditions. When the compressor operates at part load conditions the radially outward factor caused by the flow through the compressor is decreased such that the direction of flow discharged from the impeller becomes more tangential to the impeller blade. Under these circumstances the flow path length through the diffuser is increased and the potential for the velocity pressure to overcome the static resistance along the longer flow path is diminished. When the velocity pressure is unable to overcome the static pressure caused by the longer flow path aerodynamic instabilities occur and the centrifugal compressor does not operate as desired.

Also disclosed in this application is the use of movable diffuser vanes located within the diffuser to aid in routing the gas discharged from the impeller through the diffuser. By repositioning these vanes additional control is obtained over the flow path the discharge gas will take through the diffuser.

SUMMARY OF THE INVENTION

It is an object of the present invention to provide a method for reducing the energy consumed by a motor driving a centrifugal compressor.

A further object of the present invention is to provide apparatus for controlling inlet guide vanes and the energy consumption of an electric motor driving a centrifugal compressor.

It is another object of the present invention to provide a method of minimizing power consumption to a motor driving a centrifugal compressor while preventing operation under surge conditions.

A yet further object of the present invention is to provide a control system for properly positioning inlet guide vanes and diffuser vanes to minimize power consumption and to avoid operation under surge conditions for a centrifugal gas compressor.

A still further object of the present invention is to provide safe, economical, and reliable control for integrating operation of an energy efficient centrifugal compressor control system.

It is a yet further object of the present invention to provide a method of controlling centrifugal compressor to limit surge conditions within the compressor by control of diffuser guide vanes and inlet guide vanes as well as control of flow through the compressor via a blow-off valve.

Other objects will be apparent from the description to follow and the appended claims.

The above objects are achieved according to the preferred embodiment of the present invention by a method for maintaining surge control in a centrifugal compressor having an inlet, discharge and inlet guide vanes and a blow-off valve connected to the compressor discharge. The method includes the steps of determining the mass flow rate of the working fluid flowing through the compressor, calculating a bias factor based on the temperature of the working fluid at the compressor inlet, ascertaining a set point for surge control based upon a desired pressure change between the compresssor inlet and the compressor discharge, said set point being based on the sum of the mass flow rate multiplied by a constant and the bias factor, measuring the pressure change between the compressor inlet and discharge, and energizing the blow-off valve to maintain surge control in response to the measured pressure change exceeding the pressure change set point.

A method of regulating the power consumption of an electric motor driving a centrifugal compressor having an inlet, inlet guide vanes, a discharge and a pressure vessel connected to receive a working fluid from the compressor discharge is further disclosed. The method steps include determining the mass flow rate of the working fluid flowing through the compressor and calculating a minimum power consumption level for controlling surge based on the mass flow rate, measuring the pressure of the working fluid within the pressure vessel, calculating a desired power consumption set point based on a comparison of a desired pressure with the measured pressure of the pressure vessel, measuring the power consumption of the electric motor, and controlling the inlet guide vanes to vary the power consumption of the motor in response to the measured power consumption varying from the greater of the desired power consumption set point or the mininum power consumption level.

Apparatus for controlling the power consumption of a motor driving a centrifugal compressor having inlet guide vanes, a discharge line, and a pressure vessel connected to the discharge line is also disclosed. This apparatus includes means for measuring the temperature and pressure of the working fluid in the discharge line, the square of the volume flow of the fluid in the discharge line, the pressure of the fluid within the pressure vessel and the electrical power consumed by the motor, each of said means for measuring generating a signal indicative of the value measured. Signal processing means are provided to receive signals from each of the means for measuring and to calculate a minimum power consumption setting to control surge, to calculate a power setting based on a comparison of the pressure within the pressure vessel with a desired pressure level, and to generate an inlet guide vane control signal indicative of a desired inlet guide vane position based on a comparison of the power consumption measured with the higher of the power setting or the minimum power consumption setting. Additionally, means are provided for positioning the inlet guide vanes in response to an inlet guide vane signal generated by the signal processing means.

BRIEF DESCRIPTION OF THE PREFERRED EMBODIMENT

Apparatus as described herein will refer to both a method and apparatus for controlling operation of a centrifugal compressor. The particular centrifugal compressor is described as having both variable inlet guide vanes and diffuser vanes. This invention has like applicability to centrifugal compressors not having variable diffuser vanes. The description herein will refer to the measurement of selected parameters for determining when to initiate changes in the manner of operation such as positioning inlet guide vanes. Other parameters than those specifically described could be utilized to achieve the same result.

The invention is described utilizing an electric motor for powering the compressor and in conjunction therewith measurements of the power consumption of the motor are made. Obviously a steam turbine or other motive device could be used and an equivalent power analysis be made.

The contol as described herein is envisioned to be a microprocessor control such as a Foxboro Specification 200 Control System manufactured by Foxboro Company of Foxboro, Mass. Mechanical controls and hardwired electromechanical systems could be utilized instead of a programmed microprocessor.

Figure 1:
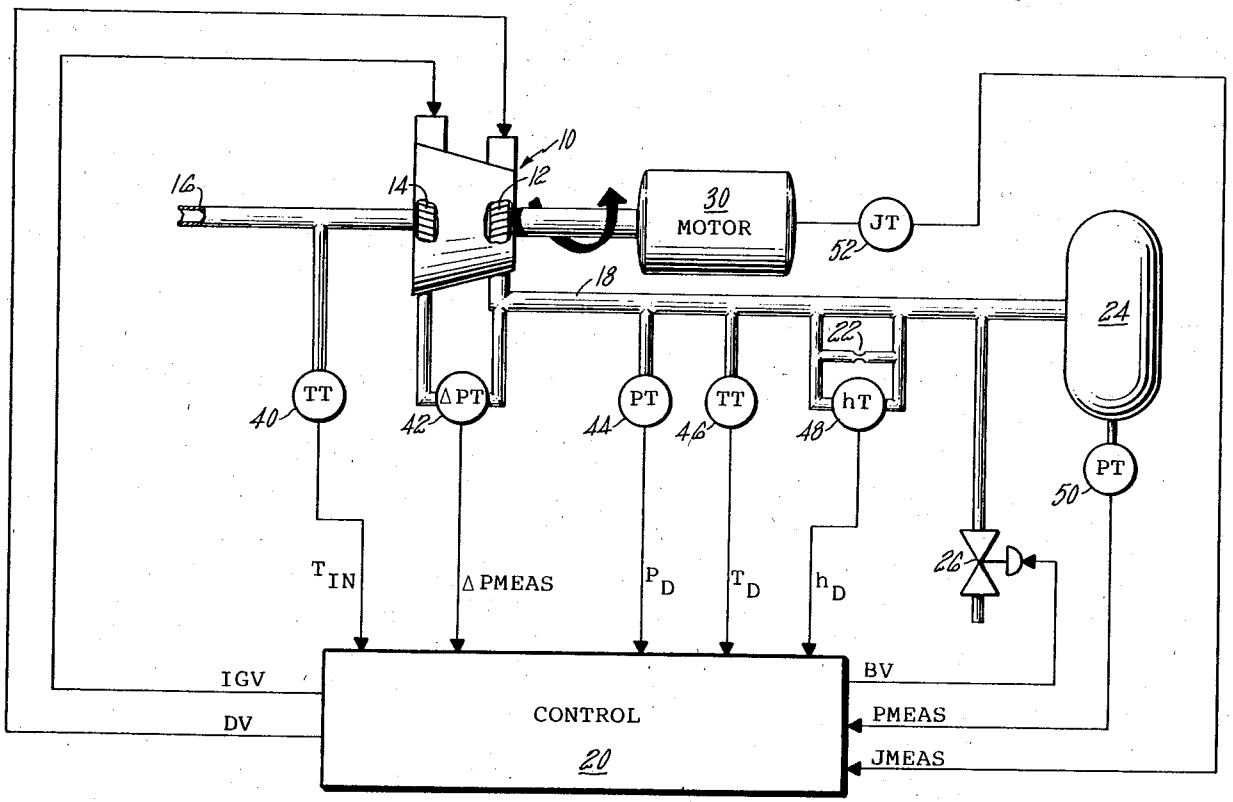
FIG. 1 is a schematic diagram of a centrifugal compressor, motor and the desired control connections.

Referring first to FIG. 1 there may be seen compressor 10 having inlet guide vanes 14 and diffuser vanes 12. Both inlet guide vanes 14 and diffuser vanes 12 are capable of being positioned over a range of positions and include motive means for positioning them appropriately. Inlet line 16 is shown for supplying gaseous fluid to the compressor. Inlet guide vanes 14 are shown positioned to control the flow from the inlet line into the compressor. Diffuser vanes 12 are shown positioned toward the discharge end of the compressor for controlling flow within the diffuser of the compressor before the flow enters discharge line 18.

The gas being discharged from the compressor flows through discharge line 18 and through orifice 22 to pressure vessel 24. Pressure vessel 24 is a collection vessel from which the pressurized fluid is supplied to the industrial process, refrigeration machine or other end use. Blow-off valve 26 is shown connected to an extension of discharge line 18. Blow-off valve 26 may be opened or closed to allow pressurized gas from the discharge line to be recirculated to the inlet line or simply dumped to atmospheric pressures. Motor 30 which may be an electric motor or some other type of motive device is shown connected by shaft 32 to the centrifugal compressor for powering same. Control 20 is shown connected to receive various inputs and to generate outputs. Control input lines are shown including temperature transmitter 40 being shown sensing the temperature of the fluid flowing through inlet line 16 and generating a signal to control 20. The signal is labeled $T_{IN}$ indicating that it is representative of the temperature of the fluid in the inlet.

Change in pressure transmitter 42 labeled ΔPT is shown measuring the change in pressure between the inlet and discharge of compressor 10. Change in pressure transmitter generates a ΔPMEAS signal to control 20. Pressure transmitter 44 labeled TT generates a signal indicative of the discharge pressure $P_d$ which is transmitted to control 20. Temperature transmitter 46 labeled PT generates a signal indicative of the temperature of the fluid in discharge line 18 and transmits a signal labeled $T_d$ to control 20. Volume squared flow transmitter 48 labeled hT senses the pressure drop across orifice 22 to sense a factor indicative of the volume squared flow times a constant to indicate flow rate. The hT transmitter generates a signal referenced $h_d$ which is conducted to control 20. Pressure transmitter 50 labeled PT generates a signal indicative of pressure within pressure vessel 24. This signal labeled PMEAS is directed to control 20. Power transducer 52 labeled JT generates a signal labeled JMEAS which is directed to control 20 indicative of the power consumed by the motor.

In addition to the various signals received by control 20, control 20 generates several output signals. These output signals are shown as dotted lines and are labeled IGV for inlet guide vanes DV for diffuser vanes and BV for the blow-off valve. The inlet guide vane signal generated by control 20 is shown as a dotted line extending to inlet guide vanes 14 and is used for indicating to the motive means of the inlet guide vanes where to position the inlet guide vanes. Additionally the signal generated over the dotted line labeled DV for diffuser vanes is connected to diffuser vanes 12 such that the motive source used to position the diffuser vanes may respond and position them as indicated by the signal generated by control 20. Blow-off valve 26 is additionally positioned in response to the signal generated by control 20 over the output line labeled BV for blow-off valve.

Figure 2:
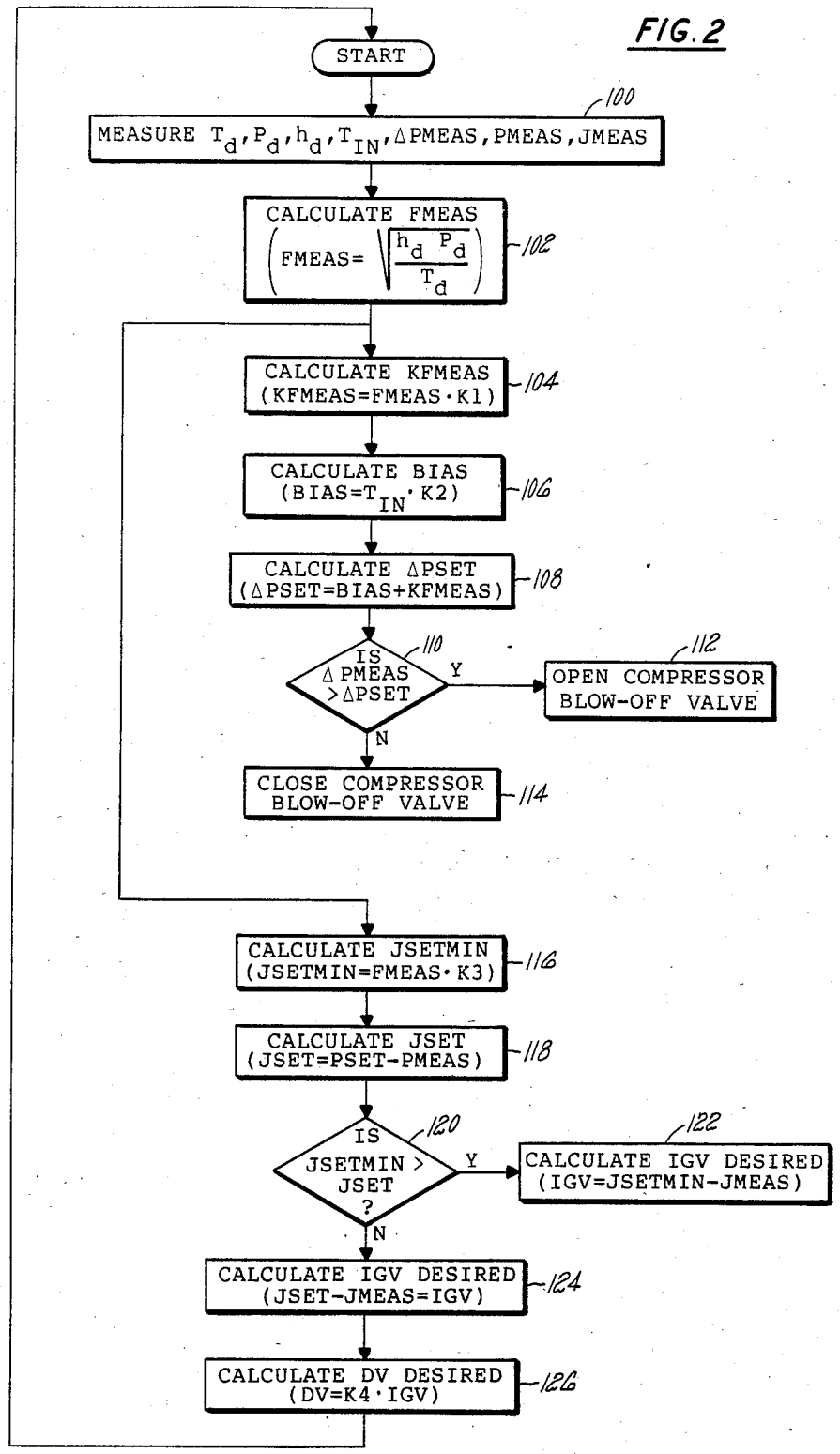
FIG. 2 is a logic flow chart outlining the method of controlling the centrifugal compressor and motor.

FIG. 2 represents an outline of the logic which may be utilized to control the inlet guide vanes, diffuser vanes and blow-off valve in response to the sensed parameters. In FIG. 2 the first step, step 100, indicates that numerous inputs will be sensed to measure the value of the parameters represented by these inputs. The inputs are temperature at the discharge ($T_d$), at the pressure discharge ($P_d$), a volume squared function of the flow of the discharge ($h_d$), temperature of the fluid at the inlet ($T_{IN}$), the change in pressure across the compressor (ΔPMEAS), the pressure of the fluid within pressure vessel (PMEAS) and the power being consumed by the motor (JMEAS). At step 102 FMEAS which is indicative of the flow through the compressor is calculated by taking the square root of the product of $h_d$ times $P_d$ divided by $T_d$. At step 104 the flow value is multipied by a factor not necessarily a constant (K1) to obtain KFMEAS.

At step 106 a separate value labeled BIAS is calculated by multiplying the temperature in ($T_{IN}$) by a factor not necessarily a constant (K2). This factor is determined from a table indicative of surge conditions under various input conditions for the particular compressor.

At step 108 a value equal to the set point for the change in pressure across the compressor labeled ΔPSET is determined by adding the value determined for BIAS with the KFMEAS value.

At step 110 a logic question is asked as to whether or not the ΔPMEAS value is greater than the ΔPSET value or in other words is the change in pressure across the compressor actually measured greater than the set point. If the answer to the question in step 110 is yes the logic will proceed to step 112 to open the compressor blow-off valve to prevent operation of the compressor in the surge region. If the answer to the logic step 110 is no, the logic directs the blow-off valve to remain closed preventing gas from being discharged therethrough. In this manner the blow-off valve position is regulated to effect surge control if necessary.

The logic additionally flows from step 102 to step 116 once the flow measurement is determined. Step 116 acts to calculate the power set point minimum necessary to maintain operation of the compressor without operating under surge conditions. This minimum set point is calculated by multiplying the flow measurement FMEAS times a factor not necessarily a constant (K3). This factor is determined again by comparing the value of flow measurement against a selected table for those operating conditions and the particular compressor. At step 118 the logic acts to calculate the power set point based upon a comparison of the pressure measured in pressure vessel 24 (PMEAS) versus the power set point necessary for operating the process involved. At step 120 the logic determines whether or not JSETMIN or the minimum power consumption value necessary to avoid surge is greater than JSET or the power level necessary to operate the process. If the answer to this logic step is yes the logic flows to step 122 and the inlet guide vanes are controlled based upon the minimum power requirements necessary to avoid surge. At step 122 the inlet guide vane position signal is calculated by comparing the JSETMIN value with the actual measured power consumption of the motor (JMEAS).

Should the answer to logic step 120 be no then the logic proceeds to step 124 where the inlet guide vane position desired is calculated by comparing the power set point of the system, JSET, to the actual power measured, JMEAS. Once the inlet guide vane position signal has been determined either by step 122 or step 124 the logic then proceeds to step 126 to calculate the diffuser vane position desired. At step 126 the diffuser vane position desired is determined as a function of the inlet guide vane position by multiplying IGV by a factor K4 which is not necessarily a constant.

Both the desired inlet guide vane position (IGV) and discharge guide vane position (DV) are calculated. Based on these calculations a signal is provided from the control to the appropriate vanes to place the vanes in the desired position such that power consumption is minimized and operation under surge conditions is avoided.

The invention has been described herein with reference to a particular embodiment. It is to be understood by those skilled in the art that variations and modifications can be effected within the spirit and scope of the invention.

We claim:

1. A method of maintaining surge control in a centrifugal compressor having an inlet, a discharge and inlet guide vanes, and a blow-off valve connected to the compressor discharge which comprises the steps of:

determining the mass flow rate of the working fluid flowing through the compressor;

calculating a bias factor based on the temperature of the working fluid at the compressor inlet;

ascertaining a set point for surge control based upon a desired pressure change between the compressor inlet and discharge, said set point being based on the sum of the mass flow rate multiplied by a factor and the bias factor;

measuring the pressure change between the compressor inlet and discharge; and energizing the blow-off valve to maintain surge control in response to the measured pressure change exceeding the pressure change set point.

2. The method as set forth in claim 1, and further including an orifice connected to the compressor discharge and wherein the step of determining the mass flow rate further comprises measuring the temperature and pressure of the working fluid at the compressor discharge, measuring the pressure drop across the orifice and calculating the mass flow rate by taking the square root of the product of the pressure drop across the orifice and the pressure at the compressor discharge divided by the temperature at the compressor discharge.

3. The method as set forth in claim 1, and further including a motor for driving the compressor, a pressure vessel for receipt of the working fluid at the discharge pressure, and means for measuring the energy being consumed by the motor and wherein the method further serves to limit the power consumption of the motor driving the compressor comprising the steps of:

calculating a power consumption set point for the motor based on the mass flow rate from the step of determining to provide a minimum power consumption level for controlling surge;

measuring the pressure within the pressure vessel;

comparing the desired pressure in the pressure vessel with the measured pressure and generating a desired power consumption signal for the motor based on the comparison;

measuring the power consumption of the motor; and controlling the compressor inlet guide means to regulate the power consumption of the motor based on a comparison of the actual power consumption measured versus the higher value of the power consumption set point calculated or the desired power consumption based on the pressure of the working fluid in the pressure vessel.

4. The method as set forth in claim 3 wherein the compressor also has diffuser guide vanes and further including the step of controlling the diffuser guide vanes.

5. A method of regulating the power consumption of an electric motor driving a centrifugal compressor having an inlet, inlet guide vanes, a discharge and a pressure vessel connected to receive a working fluid from the compressor discharge which comprises the steps of:

determining the mass flow rate of the working fluid flowing through the compressor and calculating a minimum power consumption level for controlling surge based on the mass flow rate;

measuring the pressure of the working fluid within the pressure vessel;

calculating a desired power consumption set point based on a comparison of the desired pressure with the measured pressure of the pressure vessel;

measuring the power consumption of the electric motor; and controlling the inlet guide vanes to vary the power consumption of the motor in response to the measured power consumption varying from the greater of the desired power consumption set point or the minimum power consumption level.

6. The method as set forth in claim 5 wherein the compressor further includes diffuser vanes and further comprising the step of:

controlling the diffuser guide vanes as a function of the step of controlling the inlet guide vanes.

7. The method as set forth in claim 5 wherein a blow-off valve is connected to the compressor discharge for effecting surge control and further comprising the steps of:

measuring the pressure change from the compressor inlet to the compressor discharge; and energizing the blow-off valve when the pressure change measured is greater than a desired pressure change.

8. The method as set forth in claim 7 wherein the desired pressure change is ascertained by the step of:

multiplying the mass flow rate from the step of determining by a factor and adding thereto a bias factor based on the temperature of the working fluid at the compressor inlet.

9. Apparatus for controlling the power consumption of a motor driving a centrifugal compressor having inlet guide vanes, an inlet, a discharge line and a pressure vessel connected to the discharge line which comprises:

means for measuring the temperature and pressure of the working fluid in the discharge line, means for measuring the square of the volume flow of the fluid in the discharge line, means for measuring the pressure of the fluid within the pressure vessel and means for measuring the electrical power consumed by the motor, each of said means for measuring generating a signal indicative of the value measured;

signal processing means connected to receive signals from each of the means for measuring, to calculate a minimum power consumption setting to control surge, to calculate a power setting based on a comparison of the pressure within the pressure vessel with a desired pressure level, and to generate an inlet guide vane control signal indicative of the desired inlet guide vane position based on a comparison of the power consumption measured with the higher of the power setting or the minimum power consumption setting; and means for positioning the inlet guide vanes in response to the inlet guide vane signal generated by the signal processing means.

10. The apparatus as set forth in claim 9 and further including compressor diffuser vanes wherein the signal processing means also generates a diffuser vane signal indicative of the desired diffuser vane position; and means for positioning the diffuser vanes in response to the diffuser vane signal.

11. The apparatus as set forth in claim 9 including a blow-off valve connected to the compressor discharge, wherein the means for measuring includes means for measuring the inlet temperature of the fluid and the pressure change from the compressor inlet to the compressor outlet, wherein the signal processing means calculates a pressure change set point, and wherein the signal processing means compares the pressure change set point to the measured pressure change and generates a signal to open the blow-off valve when appropriate to prevent surge.

* * * * *